US012790775B2

(12) United States Patent
Presslaber

(10) Patent No.: US 12,790,775 B2
(45) Date of Patent: Nov. 10, 2026

(54) ELEMENT FOR SLOPE SECUREMENT

(71) Applicants: BETONFORM GMBH, Gais (IT); PGH-GEOSERVICE GMBH, Matrei in Osttirol (AT)

(72) Inventor: Hansjörg Presslaber, Matrei in Osttirol (AT)

(73) Assignees: BETONFORM GMBH, Gais (IT); PGH-GEOSERVICE GMBH, Matrei in Osttirol (AT)

( * ) Notice: Subject to any disclaimer, the term of this patent is extended or adjusted under 35 U.S.C. 154(b) by 139 days.

(21) Appl. No.: 18/263,881

(22) PCT Filed: Jan. 26, 2022

(86) PCT No.: PCT/EP2022/051704
§ 371 (c)(1),
(2) Date: Aug. 1, 2023

(87) PCT Pub. No.: WO2022/171434
PCT Pub. Date: Aug. 18, 2022

(65) Prior Publication Data

US 2024/0035242 A1 Feb. 1, 2024

(30) Foreign Application Priority Data

Feb. 9, 2021 (DE) ..... 10 2021 102 985.6

(51) Int. Cl.
*E01F 7/00* (2006.01)
*E01F 7/04* (2006.01)

(52) U.S. Cl.
CPC ..... *E01F 7/04* (2013.01)

(58) Field of Classification Search
CPC ..... E01F 7/045; E01F 7/02; E01F 7/00; E01F 7/04
See application file for complete search history.

(56) References Cited

U.S. PATENT DOCUMENTS 2,712,865 A * 7/1955 Steinmayer ..... E02D 5/805 52/160
2,723,733 A * 11/1955 Petersen ..... E02D 5/805 52/160

(Continued)

FOREIGN PATENT DOCUMENTS

DE 202010010849 U1 11/2010
EP 1728924 A1 * 12/2006 ..... E01F 7/04

(Continued)

OTHER PUBLICATIONS

ISA European Patent Office, International Search Report Issued in Application No. PCT/EP2022/051704, May 10, 2022, WIPO, 4 pages.

*Primary Examiner* — Edwin J Toledo-Duran
(74) *Attorney, Agent, or Firm* — McCoy Russell LLP

(57) ABSTRACT

Element for slope protection in particular in the area of avalanche protection, soil-, debris- and rock-retention or streambed reinforcement, with an essentially cross-shaped strut part in the form of a structure of a plurality of struts joined with one another, the structure spanning a plane, with a planar retainer fixed at the strut part, and with an anchor rod or anchor element protruding backwards essentially perpendicular to the retainer and to the strut part, which is fixed to the strut part, wherein between a free end of the anchor rod and the struts retaining cables are provided respectively for tensioning of the anchor rod at a predetermined specific angle to the plane of the retainer.

11 Claims, 4 Drawing Sheets

(56) References Cited

U.S. PATENT DOCUMENTS 3,144,106 A * 8/1964 Jacobson ..... E02D 5/805 52/160
3,675,381 A * 7/1972 Watson ..... E02D 5/80 174/138 R
4,339,114 A * 7/1982 Deike ..... E01F 7/02 403/171
4,759,606 A * 7/1988 McDowell ..... B60Q 7/005 116/63 P
5,694,711 A * 12/1997 Cowgill ..... G09F 15/0025 40/586
6,279,858 B1 * 8/2001 Eicher ..... E01F 7/04 256/33
7,708,502 B2 * 5/2010 Carte ..... E02D 17/207 405/302.4
9,062,422 B2 * 6/2015 Canepari ..... E02D 29/0233
2007/0080331 A1 * 4/2007 Roth ..... F16G 11/146 256/12.5
2007/0224021 A1 * 9/2007 Travi ..... E01F 7/04 414/24.5
2010/0243977 A1 * 9/2010 Middlebrook, Jr. ..... E01F 7/00 256/12.5
2014/0044494 A1 * 2/2014 Canepari ..... E02D 29/0233 405/262
2015/0191928 A1 * 7/2015 Germain ..... E04B 1/0007 52/167.7
2019/0039629 A1 * 2/2019 Cylvick ..... B61B 12/007
2022/0307209 A1 * 9/2022 Szczerba ..... E01F 13/022

FOREIGN PATENT DOCUMENTS

EP 2848737 A1 * 3/2015 ..... E01F 7/04
FR 3026117 A1 * 3/2016 ..... E01F 7/04
IT BZ20060030 A1 1/2008
WO WO1997037085 A1 * 10/1997
WO 2011117790 A1 9/2011

* cited by examiner

ELEMENT FOR SLOPE SECUREMENT

CROSS REFERENCE TO RELATED APPLICATIONS

The present application is a U.S. National Phase of International Application No. PCT/EP2022/051704 entitled "ELEMENT FOR SLOPE SECUREMENT," and filed on Jan. 26, 2022. International Application No. PCT/EP2022/051704 claims priority to German Patent Application No. 10 2021 102 985.6 filed on Feb. 9, 2021. The entire contents of each of the above-listed applications are hereby incorporated by reference for all purposes.

TECHNICAL FIELD

The invention relates to an element for slope protection, in particular in the area of avalanche protection, soil, debris, and rock retention or stream reinforcements, as is defined in the preamble of claim 1. Such elements for the protection of debris-, soil-, or streambed-reinforcements are used, for example, in order specifically to protect areas which are susceptible to the falling of avalanches or of debris in mountain regions or at slopes. Such elements are also used for an avalanche protection, in order to construct retaining elements or retention areas at places where there is a risk of avalanches of snow. Such elements for slope protection are also used, for example, in road building when cuts are made into the mountainous terrain at the sides of roads, in order to protect these side areas from a fall of soil or rock, in particular during storms or the like.

BACKGROUND AND SUMMARY

Such elements for slope protection are known in the prior art in different forms. For example, an element for avalanche protection or slope protection is known from DE 20 2010 010 849 U1, in which a plurality of round timber is fixed on an essentially frame-like basic structure by means of straps made of wires. This element has proved effective in the area of avalanche protection, but it has the disadvantage that it is not formed flexible enough for use in determined other and often uneven areas. For example, in the area of the reinforcement of riverbeds or streambeds, this element can only be used with difficulty as it has a relatively rigid outer shape and does not provide any possibilities at all for adaptation to different geological conditions.

Furthermore in the prior art, such slope protection elements have been proposed in which there are two support elements joined with one another in a kind of cross-shape, which are displaceable in relation to one another in a scissor-like manner. This form of a cross-shaped slope protection element displaceable in a scissor-like manner, with the advantage of a defined flexibility of the structure has, however, the disadvantage that even with this, sometimes it is only possible to badly realise an adaptation to different conditions of the respective mounting position, and that the variability in the shape of the respective element is relatively limited. The two individual struts of the structure can only be mounted together with one another, and therefore they are not easily adaptable in shape and size to different conditions of the mounting position.

With this in mind, it is the object of the present invention to provide an element for slope protection which has an improved possibility of adaptation and greater variability in the shape and size, mounting position and embodiment according to the geological conditions present. Furthermore, the element of the present application according to the invention should also allow easier transportation, possibilities of more compact stowage, and simpler assembly at the often hard-to-reach slope positions for the use and the installation of the elements.

This object is solved by means of an element for slope protection having the features of claim 1. Advantageous embodiments and developments of the invention are the subject matter of the dependent claims.

According to the invention and as given in claim 1, an element for slope protection in particular in the area of a soil retention, an avalanche protection, or of streambed reinforcements, is proposed with an essentially cross-shaped strut part in the form of a structure spanning a plane made of a plurality of struts coupled with each other, with a planar retainer or retention means fixed at the strut part, and with an anchor rod or anchor element protruding backward essentially perpendicular to the retainer and to the strut part, which is fixed at the strut part, wherein between a free end of the anchor rod and the struts there is provided at least in each case a retaining cable or a plurality of retaining cables for the tensioning of the anchor rod at a pre-set specific angle to the plane of the retainer, and wherein the element is characterised in that, at the strut part, a central coupling element is provided at which the struts are fixed in each case with one of their ends releasable and/or displaceable in relation to one another, and that the anchor rod is mounted at the coupling element movably in a plurality of directions, in particular, in all directions, for adjusting a mounting angle in relation to the plane of the retainer. With the slope protection element formed in this way and the central coupling element provided in the middle at the strut part, a modularly constructed, diversely modifiable system is provided which can be specifically and easily adapted respectively in the respective areas of application: the struts can be replaced individually at the central coupling element due to the releasable fixing and for example provided with different lengths. Thereby it is possible to realise, for example, square, rectangular or even asymmetric shapes of the strut part and of the retainer of the element. The struts are in each case releasably fixed at the coupling element and can in each case separately be easily adapted corresponding to the respective conditions. Furthermore, the anchor rod of the element according to the invention is mounted movably in particular in all directions at the coupling element, so that it is possible to easily change the anchor rod corresponding to the respective incline of the slope position in which the element is to be mounted. The movability of the anchor rod in a plurality of directions and in particular in all directions furthermore has the advantage that the anchor rod can also be, for example, laterally displaced in order, for example, to allow an inclined assembly at a slope.

The element according to the invention is therefore very variable in its application. The element is more or less completely modularly constructed and the individual parts can be easily replaced and changed, also, for example, when individual elements are damaged. The modular construction also allows a temporary protection for excavation pits, wherein the removal thereof does not have to be carried out in whole but also, if required, as individual support parts.

The element according to the invention furthermore has the advantage that the on-the-spot assembly can be done quickly and with relatively small effort. The individual struts, the anchor rod and the central coupling element can all be transported as individual parts and as a result have a relatively small transport size. In the case of rough terrain, the individual parts can also if necessary be carried singly or in groups by a worker and then, on the spot, assembled for use. Different forms of retainers can be used as a retainer with a planar embodiment on the strut part: for example, nets, wire mesh, or also wooden posts or metal supports mounted parallel to one another, can be fixed at the respective struts of the strut part. The struts themselves are joined to the anchor rod by means of a retaining cable or a plurality of retaining cables, so that a secure tensioning of the anchor rod in the intended inclined position and at the pre-set angle is allowed. The element for slope protection according to the invention furthermore has the advantage that the variable assembly and releasable fixing of the struts, and the assembly and fixing of the anchor rod itself, take place with only a single central element, namely the coupling element. Therefore, relatively few complex elements are required for the constructing and the installing of the slope protection element.

According to an advantageous embodiment of the invention, the planar retainer at the structure part and strut part is a wire mesh or a net. For example, metal wire meshes, or metal or textile nets can be used, which form a retention means for the debris, the avalanche fall, or the rock or soil between the struts arranged cross-shaped. According to the purpose of use, for example, for soil, a more closely-meshed net or a more closely-meshed wire mesh can be used. The fixing of rock falls or avalanches can also require a stronger form of the retainer, so that for example rigid metal lattices or individual wooden or metal struts can be used at the strut part additionally or alternatively to the setting up of the planar retainer. The element according to the invention is therefore very diverse with regard to the purposes of use and can easily be optimally adapted on the spot by the installation operatives, also with regard to the specific requirements.

According to a further advantageous embodiment of the invention, the coupling element is formed as a coupling element with a folding hinge. Thus the coupling element itself comprises a folding hinge or is constructed as a folding hinge, which is realised, for example, by means of a hinge-like articulation at a middle area of the coupling element. In this way, it is possible to open the coupling element specifically for example for inserting the anchor rod into the middle recess. Furthermore, for transportation it is possible to fold the already pre-assembled struts together on one another in pairs, so that the size and the volume are reduced for the transportation of the element.

According to a further advantageous embodiment of the invention, the coupling element has a central opening, recess or bore for swivelable reception of a hinge part of the anchor rod. The coupling element thus serves not only for assembly and fixing of the struts of the strut part or of the structure, but also for the central assembly and retention of the anchor rod at one and the same element. Therefore, the coupling element is, so to say, the connection and middle retainer for the individually fixed struts of the strut part and also for an assembly and hinged mounting of the swivelable anchor rod. For this, besides the receiving means for the annularly-protruding struts, the central coupling element has a central opening, recess or bore which is configured to receive the anchor rod therein directly in a hinged manner. Alternatively, a separate hinge part can also be inserted. The hinge connection can be formed, for example, as a type of ball joint, a pin/bore hinge or other forms of hinges. The reception at the coupling element is formed such that directly a hinged or articulated integration of the anchor rod in the coupling element is allowed. Therefore, additional component parts like joint sleeves or the like are not absolutely indispensable; however, they can also be used for the purpose in alternative embodiments according to the invention. The construction of the element according to the invention is therefore structurally surprisingly simple and provided with large variability and many possibilities of function. A kind of completely modular new form of such elements for slope protection is provided. The number of necessary individual parts is significantly reduced.

According to a further advantageous embodiment of the invention, the coupling element is formed as a central folding lock for opening and closing a joint receiving means for a hinge joint or a hinge part of the anchor rod. Such a lock can, for example, be manufactured as a rotatable or folding element which in each case opens the opening or receiving means of the hinge joint for receiving the anchor rod and securely closes it again, by means of the coupling element itself being actuated. Such a lock can, for example, be manufactured from a plate-like or box-type element with hinge-like connection and partitioning in the middle. The assembly is thereby facilitated and the necessary individual parts are reduced. Other types of coupling elements in a lock form which are known to the person skilled in the art in this field can likewise be used for this. Here too, the construction of the slope protection element is further simplified, and diverse modular variations of the element are possible without replacing the basic components of the element. Even on the spot, for example different shapes or lengths of anchor rods can be inserted in the lock of the coupling element. Also, in this way, the adaptation to the different geological conditions can be realised even better.

According to a further advantageous embodiment of the invention, the struts each have a plurality of fixing places for the retaining cables. The retaining cables, which are stretched between the free end of the anchor rod and the struts, can in this way also be mounted at a plurality of points at the respective struts. For example, building on a base version with four retaining cables in the case of four struts arranged cross-shaped, also eight retaining cables with four struts and in each case two fixing places can be used, so that the strength and stability of the element is further increased. This also has the advantage that in the case of determined geological conditions like rocks or the like, the cables can be secured and tensioned at different positions of the struts according to requirement. According to an alternative embodiment of the invention, the fixing places at the struts serve at the same time as retainer for the retaining cables and the planar retainer, like for example a net part.

According to a further advantageous embodiment of the invention, releasable fixings for the struts are respectively provided at the coupling element. The releasable fixings can for example be realised in the form of two screw holes per strut for screw bolts with protruding holding flanges at the coupling element. The releasable fixings can also be realised in the form of plug connections or form-fitting connections. With the releasable fixings at the coupling element the struts can easily be mounted on the spot and, if required, for example used for differently required lengths of the struts for a change of the strut shape. The struts are therefore also, in each case independent of one another, connected and fixed at the central coupling element. In this way, different angles in the fixing of the struts can also be realised, for example by means of realising differently aligned angle adjustments of the releasable fixings at the coupling element. The shape of the releasable fixing elements can thereby vary: for example, there can be provided four annular, protruding supports or flange parts with screw holes corresponding to the screw holes at the free ends of the struts, in which screw bolts with nuts can be mounted. The struts are thereby preferably mounted with at least two screw connections per strut at the central coupling element, so that a secure lateral fixing and stability of the strut part is guaranteed despite the releasable assembly.

According to a further advantageous embodiment of the invention, at the coupling element in the angle of the struts, variably adjustable fixings for the individual struts are provided. The variable adjustability with regard to the angle of the struts can for example be obtained by different screw holes, slot holes or other measures suitable for this. With slot holes, a pre-assembly with subsequent angle adjustment of the struts in relation to one another can also be allowed. In this way, with one and the same coupling element a different angle adjustment of the struts to one another and in relation to the whole construction of the element can be achieved. This has considerable advantages when, for example, at the mounting place, rocks or unevenness have to be compensated.

According to a further advantageous embodiment of the invention, in the coupling element there is provided a receiving means configured to the shape of a hinge part for a correspondingly-shaped hinge part in an anchor rod. The receiving means in the coupling element is for example a bore or an opening area in which a correspondingly-shaped hinge part for the anchor rod can be simply inserted. The hinge part can thereby itself be part of the anchor rod, for example in the form of a round or semicircular projection or of a spherical element, or the hinge part can alternatively be a separate part at which the anchor rod is then itself fixed. According to an advantageous embodiment, a combination of a spherical head with a ball socket is used as a hinge part, wherein the spherical head is provided either on sides of the anchor rod or on sides of the coupling element. This allows a movability of the anchor rod in all directions. Alternative hinge parts are for example anchor rods with spherical semicircular projection, double pin-/bore connections with movability in a plurality of axes or the like, as it is known to the person skilled in the art for such hinged connections of rods for slope elements.

According to a further advantageous embodiment of the invention, the opening or receiving means of the coupling element for the hinge part can be realised by a folding hinge fixable with screw connections or levers, in which an inserting of the anchor rod for opening is allowed. The central opening is therefore realised as a type of folding part, which can be unfolded to allow an inserting in correspondingly shaped recesses in the coupling part. Therefore, the coupling element can take over the fixing and the hinged retention of the anchor rod in one and the same component part. The number of necessary elements and parts of the construction is therefore further reduced. Also, the assembly and the construction of the slope protection element are hereby even simpler.

According to a further advantageous embodiment of the invention, the retaining cables are provided with means for adjusting the effective length and/or means for pre-loading. Hereby, the individual cables can be firmly fixed in the angle position on the spot and according to requirement also more strongly or less strongly tensioned. The tensioning of the strut part and thus of the retaining element (net, mesh etc.) can be achieved even more effectively in this way. The individual lengths of the cables can be changed such that the intended angle position of the anchor rod in relation to the plane of the planar retainer is firmly fixed in the intended shape and can thus be optimally adapted on the spot to the corresponding geological conditions. The individual cables can for example be realised with tensioning loops or tensioning elements. Alternatively, also spring-loaded tensioning elements can be provided, in order to allow a determined flexibility in the connection of the strut part at the anchor rod.

BRIEF DESCRIPTION OF THE FIGURES

Further advantageous embodiments, features, advantages and realisations of the invention are disclosed in the following description of a plurality of exemplary embodiments, which follows in detail with reference to the Figures of the drawing. The invention is not limited to the exemplary embodiments shown there, but is variable in the framework of the scope of the attached claims. In the drawings:

DETAILED DESCRIPTION

Figure 1:
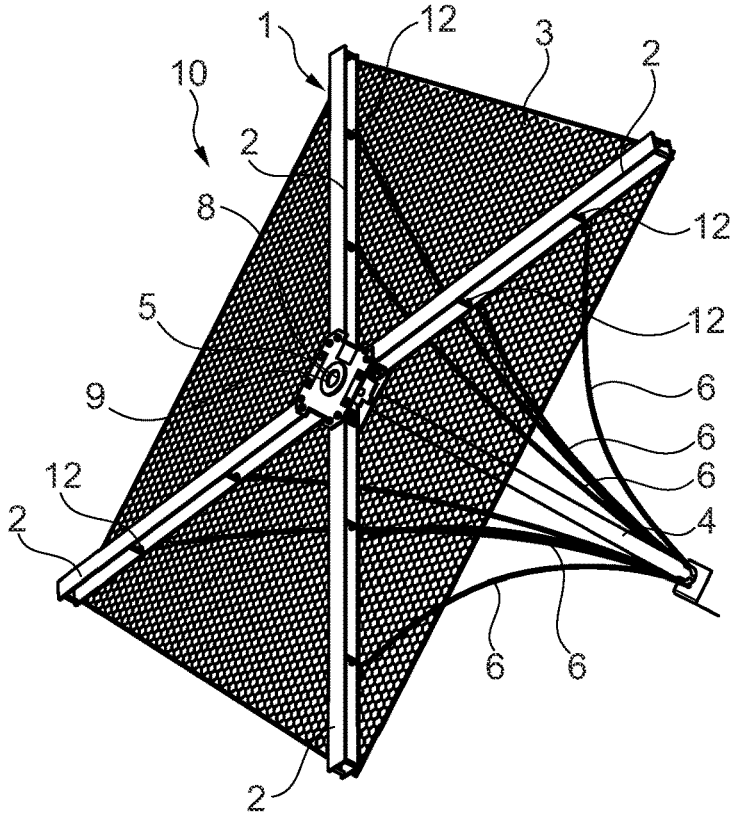
FIG. 1 shows a perpendicular lateral view of a slope protection element of the invention, constructed and assembled ready for use, according to a first embodiment.
Figure 2A:
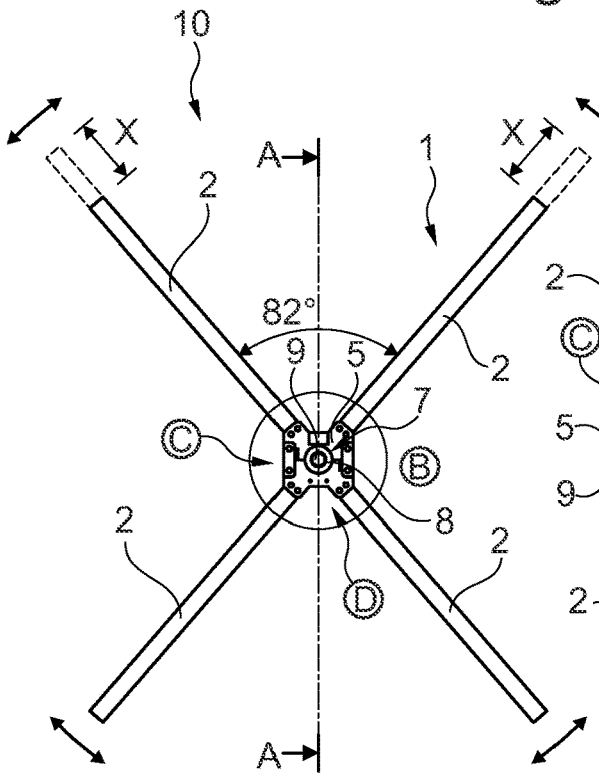
FIG. 2*a* and FIG. 2*b* each show a plan view and a lateral view of the first embodiment of the invention without planar retainer.
Figure 2B:
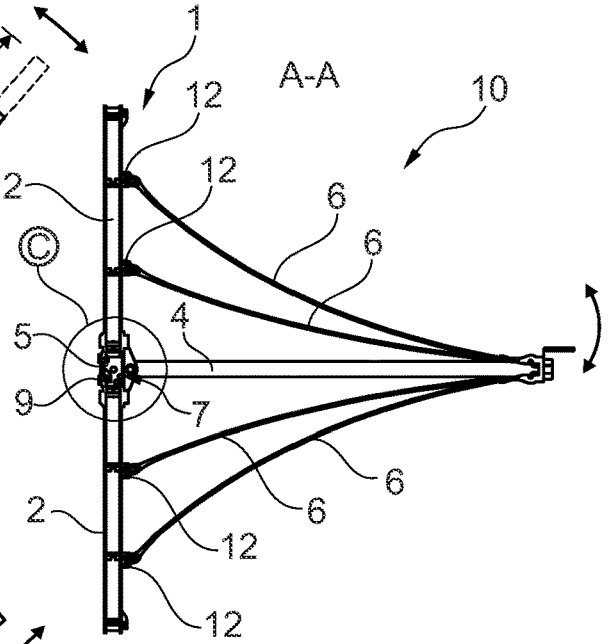

FIG. 1 of the drawing shows in a perpendicular lateral view a first embodiment of an element 10 for slope protection in the constructed and ready-for-use state with a planar retainer 3 in the form of a mesh or net. The FIGS. 2*a* and 2*b* show a plan view and a lateral view of the corresponding first embodiment of the element 10 according to the invention and in FIGS. 3, 3*a* to 3*c*, corresponding detailed views or partial views are shown for illustrating the way of functioning and construction of the element 10 with regard to a central coupling element 5. According to this first embodiment, the element 10 for slope protection comprises a strut part 1 or structural part in the form of four struts 2 protruding X-shaped, which are releasably fixed at a central middle coupling element 5. At a rear side of the strut part 1, by means of a fixing with the coupling element 5, an anchor rod 4 is mounted, which is used for anchoring backwards in the soil or for inclined assembly at the floor at the place of mounting. The anchor rod 4 is secured at its free ends with retaining cables 6 at the struts 2 by means of corresponding fixings 12. The anchor rod 4 is mounted and assembled in a central opening 8 or receiving means in the coupling element 5 by means of a hinged form, so that it has a movability in particular in all directions in a range of, for example, up to 30°, preferably in a range of at least 5° to 20° in relation to the plane of the retainer 3 (cf. arrows in FIG. 2*b*, FIG. 4 and FIG. 5*a*).

Figure 3A:
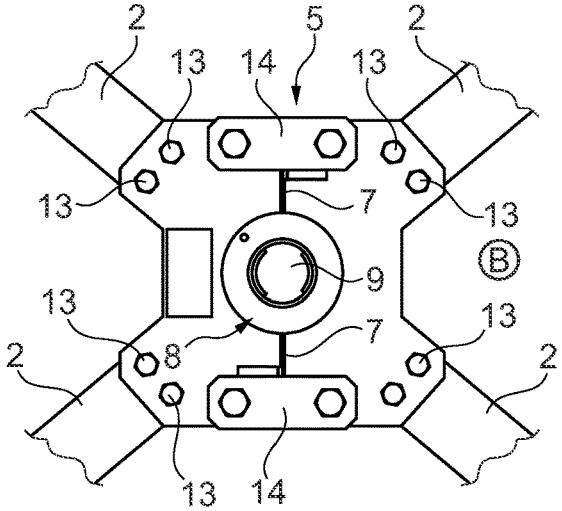
FIG. 3*a* shows an enlarged partial view of the plan view of the first embodiment of the element according to the invention in the area of the coupling element.
Figure 3B:
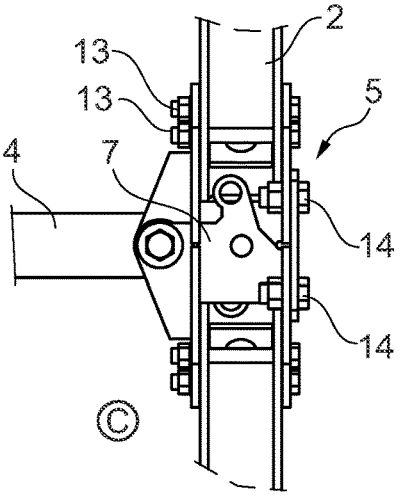
FIG. 3*b* and FIG. 3*c* show partial lateral views in enlarged representation of the element for slope protection according to the invention, according to the first embodiment in the area of the coupling element and of the assembly of the anchor rod provided with a hinge part.
Figure 3C:
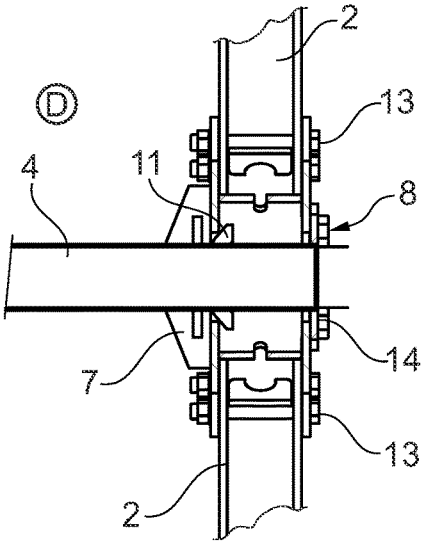
Figure 3D:
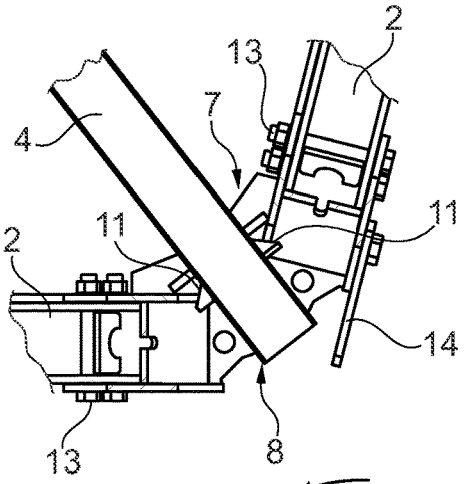
FIG. 3*d* shows an enlarged partial view of the folded-up situation of the embodiment of the element for slope protection according to FIG. 3.

The strut part 1 of the element 10 of this embodiment is realised with four struts 2 in the form of H-profiles, having approximately same length. Other forms of struts 2 can also be used, which in each case are releasably fixed at the central coupling element 5 by means of screws or similar fixing means. The coupling element 5 itself is formed with a folding hinge 7, so that it can be unfolded in a central middle area after an opening of fixing screws or the like (cf. FIG. 3 and FIG. 3*d*). The coupling element 5 therefore serves not only for the fixing and releasable assembly of the individual struts 2, but also for the receiving and as a lock for the fixing and assembly of a hinge part 9, 11 of the anchor rod 4. For this, a central opening 8 or recess is provided in the middle area of the coupling element 5, which can be opened by unfolding the folding hinge 7 for the assembly of the anchor rod 4. Subsequently, the coupling part 5 is folded together again, and again fixed in the assembled position with fixing screws and with screw fittings 14 provided with plate elements (cf. FIGS. 3*a*, 3*b* and 3*c*). The struts 2 of the strut part 1 are likewise releasable via screws 13 at the corresponding supports or flange portions of the coupling element 5. Hereby, the whole construction of the modularly assembled element 10 can be easily adapted corresponding to the respective requirements and conditions, for example by means of using different lengths of struts 2 (cf. FIG. 2*a* and length variation with the distance X) or that the angles of the struts 2 to one another are varied by changing the mounting angle at the coupling element 5 (cf. arrows in FIG. 2*a*).

The planar retainer 3 of the slope protection element 10 in this example is a wire mesh or mesh part which is fixed at the rear side of the struts 2 at corresponding places 12 together with the retaining cables 6. For this, a plurality of different fixing places 12 at the struts are provided in each case, in which the retaining cables 6 and the planar retainer part 3 can be inserted and fixed together. Alternatively, the planar retainer part 3 can also be fixed separately and differently. In the embodiment according to FIG. 1 and FIG. 2*b*, eight retaining cables 6 are each assembled with a free end of the anchor rod at the struts 2. However, also alternatively merely four retaining cables 6 can be used for tensioning and adjusting the intended angle of the anchor rod 4 (cf. FIG. 5*a* and FIG. 6).

Figure 3:
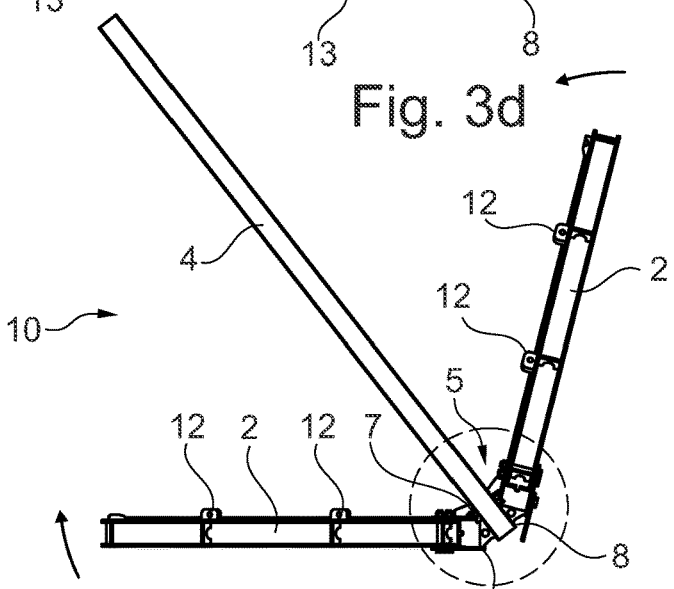
FIG. 3 shows a lateral view of the first embodiment of the element according to the invention for slope protection with partly folded-up strut part for mounting of the anchor rod in the constructed state.

In FIG. 3, the first embodiment of a slope protection element 10 according to the invention is shown in a folded-up position of the strut part 1 and of the coupling element 5, in order to be able to insert the anchor rod 4 in the opening 8 in the middle area of the coupling element 5. As can also be seen from the detailed views of FIGS. 3*a*, 3*b*, 3*c* and 3*d*, in this first embodiment the element 10 has a coupling element 5 with a folding hinge 7, in which a middle opening 8 for the inserting of the anchor rod 4 is provided. The anchor rod 4 is provided with a semicircular cone-shaped projection, at which a hinge part 11 is provided for swiveling the anchor rod 4 in relation to the plane of the struts 2 of the strut part 1 (cf. FIGS. 3*c* and 3*d*). The anchor rod 4 is inserted into the opening 8 in the folded-up state of the folding hinge 7 and subsequently the coupling element 5 is folded back again and secured with corresponding lugs or screw connections 14 (cf. FIG. 3*a* and FIG. 3*c*). Then the basic construction of the element 10 is ready for mounting and only the planar retainer 3 (cf. FIG. 1) and alternatively or additionally the retaining cables 6 are mounted at corresponding fixing points 12 of the struts 2. Hereby, an intended inclined position or angled position of the anchor rod 4 can be correspondingly adjusted, so that for example in the range of 10° to 30° a swivelability can be adjusted according to the geological conditions and the inclination of a slope.

In this first embodiment of the invention, the coupling element 5 is a part provided with wreath-like or annular flange portions, in which in each case two bores for screw connections 13 are provided for mounting the struts 2. The struts 2 can, if required, also be mounted at another angle in relation to one another, for example by means of using other holes or by means of using elongated holes and slot holes for the screw connections 13 of the struts. After a closing of the folding hinge 7 and the inserting of the anchor rod 4, the anchor rod 4 is securely held in the opening 8 of the coupling element, but in a determined range for example from 5° to 20° or even up to 30° it is movably supported in all directions. The struts 2 themselves are mounted with the coupling element 5 by means of releasable connections. By means of the folding hinge 7, furthermore in each case two struts 2 can be folded together on one another, for example to facilitate the transportation or to correspondingly further adapt the element 10 to a mounting situation. The element 10 according to the invention is thereby completely modularly constructed and very variable in the possible applications. Differently long struts 2, different angle adjustments of the struts 2 in relation to one another, and the angle of the anchor rod 4 can be correspondingly adjusted and fixed with the retaining cables 6 in an intended amount. The retainer 3 at the strut part 2, which here is mounted backwards on the side of the anchor rod 4, can also have another form, for example textile nets, rod elements, mesh parts or strut parts can be used, according to which type of reinforcement (avalanche protection, debris protection, rock retainers etc.) is to be realised with the element 10.

In FIGS. 4, 4*a* to 4*d*, a second embodiment of the element 10 for slope protection according to the invention is presented in a lateral view and in detailed views. In contrast to the first embodiment described above, here the hinged connection of the anchor rod 4 at the coupling element is realised differently: instead of a hinge part 11 directly molded on at the anchor rod 4, in this second embodiment a combination of a spherical head with a ball socket is provided for the polydirectional movability of the anchor rod 4. The hinge part 9 is a separate element with a spherical head which, like the first embodiment, can be inserted in a middle opening 8 of the coupling element 5 by opening of the folding hinge 7 (cf. FIG. 4*b* and FIG. 4*d*). The anchor rod 4 itself has at its end facing the strut part 1 a ball socket 16 (cf. FIG. 4*a*), in which the hinge part 9 formed as a spherical head can be inserted and secured with a pin 17. In this way, an optimal movability of the anchor rod 4 in all directions is allowed and in this way an improved adaptation to local conditions can take place.

Figure 4:
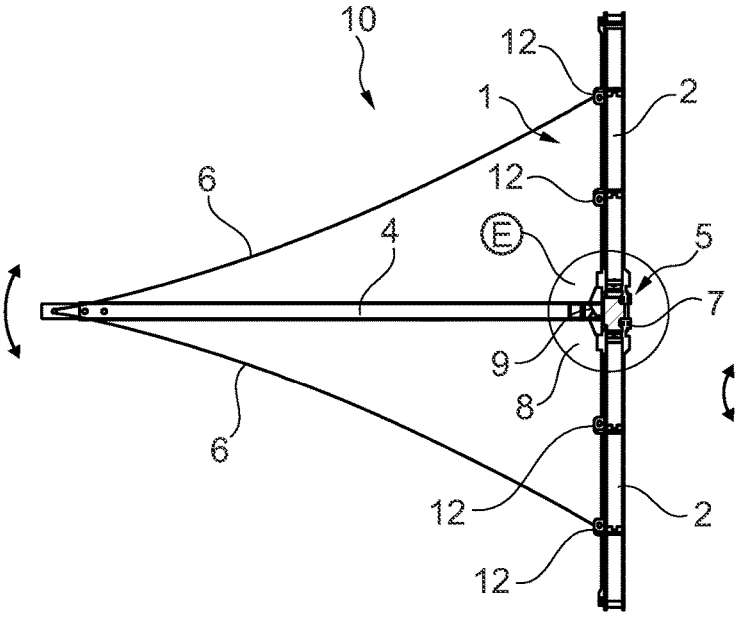
FIG. 4 shows a lateral view of a second embodiment of an element for slope protection according to the invention with alternative shape of a hinge part.
Figure 4A:
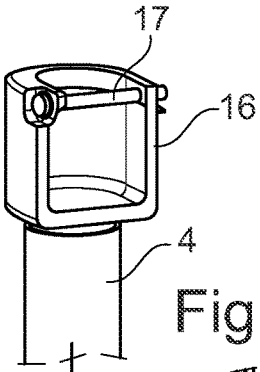
FIG. 4*a* to FIG. 4*d* show detailed views of the second embodiment of an element for slope protection according to the invention in the area of the coupling element and of the hinge part with spherical head and ball as hinge part.
Figure 4B:
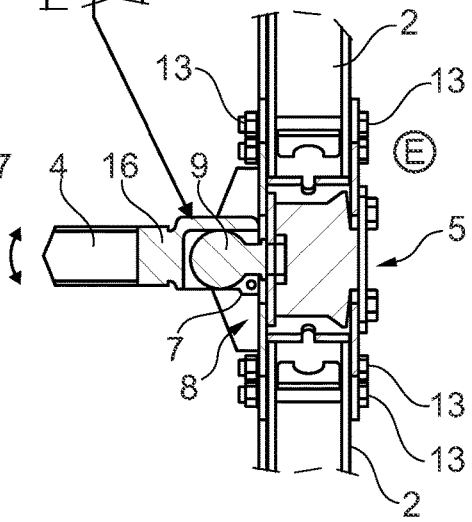
Figure 4C:
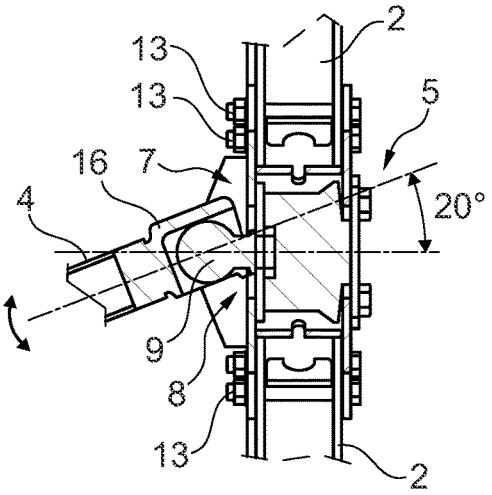
Figure 4D:
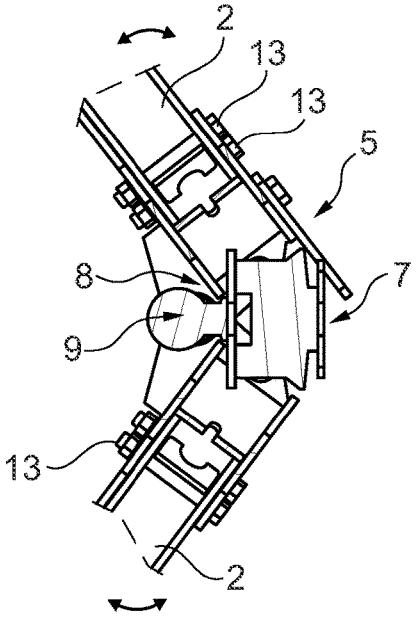

The angle of inclination of the retaining part 1 can in this way be changed by means of varying the anchor rod 4 in relation to the strut part 1 with the four releasably fixed struts 2. On the other side, in this second embodiment a reduced number of retaining cables 6 is provided. Here, as shown in FIG. 4, only four retaining cables 6 are mounted between the free end of the anchor rod 4 and the outer fixing places 12 at the struts 2. The fixing places 12 located further inside can likewise be used for the securing of the retaining cables 6. Also in this embodiment of the invention, the planar retainer 3 (not shown in the Figures) can be mounted together with the retaining cables 6 at the rear side of the strut part 1, for example at the fixing points 12. In other regards, the element 10 for slope protection of the second embodiment is comparable with that of the above-described first embodiment, so that this can be referred to for the parts and identical elements described there.

In particular, also the struts 2 in this second embodiment are releasably mounted by means of screw connections 13 at annularly-protruding flange portions of the central coupling element 5. As a result, different lengths of struts 2 can be used. For example, rectangular or even asymmetric elements 10 can be realised in this way. Also, by means of the changing of the angle of the mounting elements at the coupling element 5, like for example a change of the screw connections 13 (cf. FIG. 3*a* and FIG. 4*b*) the angle of the individual struts in relation to one another can be varied. The elements 10 of the invention are therefore modularly diversely modifiable and can be well adapted to respective on-the-spot requirements and conditions. Also in this second embodiment, in each case two struts 2 can be folded together on one another with the hinge 7 at the coupling element 5, so that the transportation is easier and the mounting of the anchor rod 4 in the central opening 8 in the way of a lock element is allowed (cf. FIG. 4*d*, FIG. 3*d*).

Figure 5B:
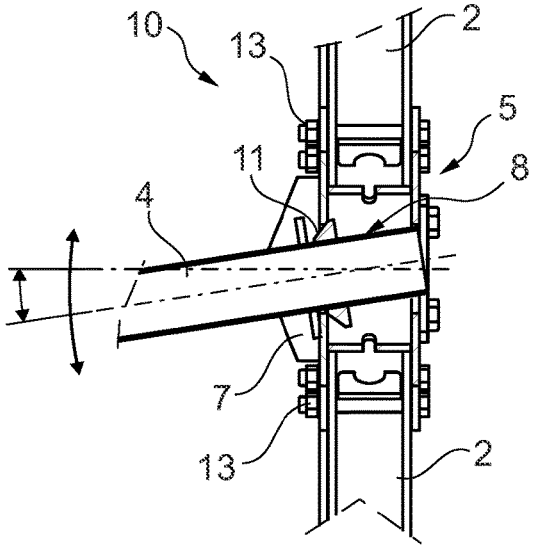
FIG. 5 shows a lateral view of the first embodiment of the element for slope protection according to the invention for illustrating the movability of the anchor rod with a detailed view FIG. 5*b* in the area of the coupling element and hinge part.
Figure 5A:
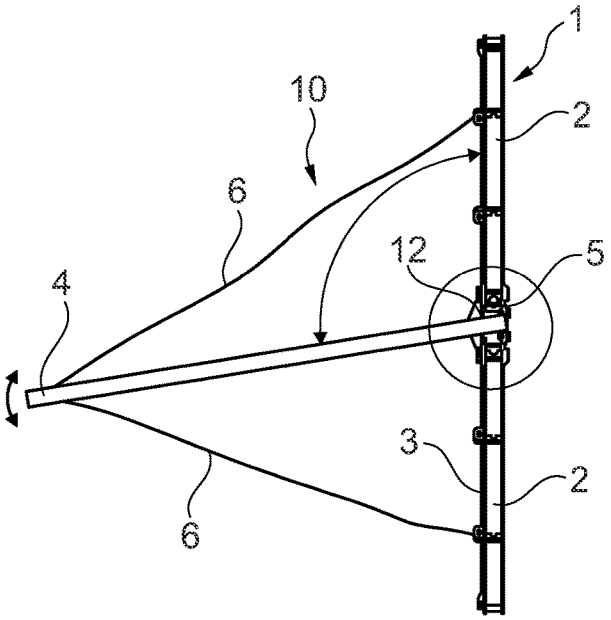
Figure 6:
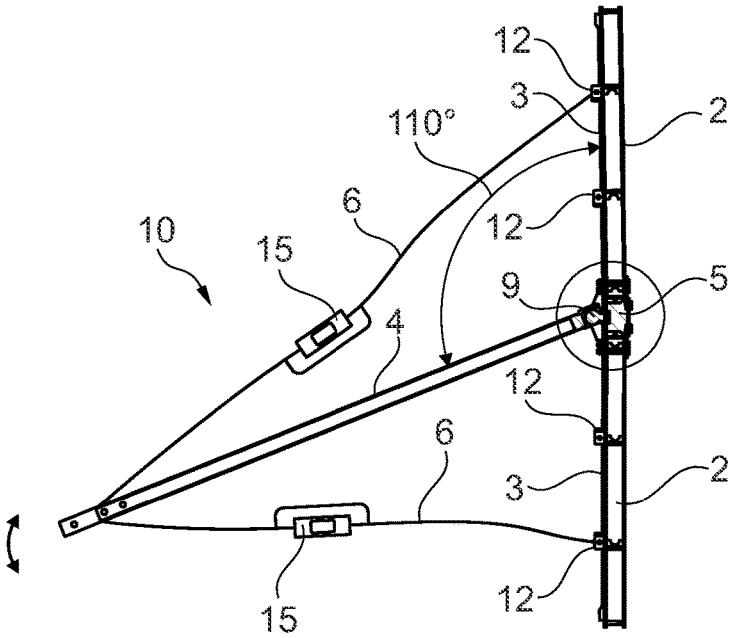
FIG. 6 shows a lateral view of the second embodiment of the element for slope protection according to the invention for illustrating the movability and swivelability of the anchor rod for the assembly.

In FIGS. 5*a*, 5*b* and FIG. 6, the two embodiments are shown again in respective lateral views and a detailed view (FIG. 5*b*) for illustrating the adjustability of the angle of the anchor rod 4 in relation to the plane of the strut part 1 with its retainer 3 (cf. FIG. 1) and with the in each case releasably mounted individual struts 2. Therefore, the anchor rod 4 can in each case be adjusted and firmly fixed at the intended angle by means of corresponding retaining cables 6. In the embodiment according to FIG. 6, for this, adjusting means 15 are provided at the retaining cables 6, by means of which the effective length of the retaining cables 6 can be changed or a tensioning can be obtained. Alternatively or additionally, also spring elements or the like can be included in the construction, so that a kind of pre-tension can be adjusted at the retaining cables 6. With the elements 10 for slope protection according to the invention, many applications are therefore realisable elaborate changes to the construction being necessary. The construction can easily be varied on the spot by the installation operatives themselves, without major modifications or adaptation work being required for this.

The struts 2 of the strut part 1 can also have another shape than the shown shape: T-supports, I-supports or also simple round or square tubes can be used instead of H-shaped supports. In the embodiments shown, the anchor rod 4 is formed as a hollow round tube. Other rod elements, for example rods of solid material, U-profiles or the like, can also be used as long as a hinge part 9, 11 for the hinged connection to the central coupling element 5 is present and as long as the individual struts 2 can be releasably mounted together with the anchor rod at the central coupling element 5. In the two shown embodiments, the struts 2 are connected by means of screw connections 13 as releasable fixings with the annularly-protruding flanges of the coupling element 5. Instead of screw connections, also other types of releasable connections, like for example clamps, locking pins, form-fitting connections etc. can be used, as long as the struts 2 at the central coupling element 5 can be mounted and fixed securely for the assembly.

The invention claimed is:

1. An element for slope protection, comprising:

an essentially cross-shaped strut part in the form of a structure of a plurality of struts joined with one another, the structure spanning a plane, with a planar retainer fixed at the strut part, and with an anchor rod or anchor element protruding backwards essentially perpendicular to the retainer and to the strut part, which is fixed to the strut part, wherein between a free end of the anchor rod and the struts retaining cables are provided respectively for tensioning of the anchor rod at a predetermined specific angle to the plane of the retainer, wherein at the strut part a central coupling element is provided, at which the struts with one of their ends are fixed releasably and/or displaceably in relation to one another respectively, and that the anchor rod at the coupling element is mounted movably in all directions before fixation or adjustment of the retaining cables for the adjustment of a mounting angle in relation to the plane of the retainer, and wherein, for an assembly and opening and for closing of a hinge joint receiving opening for a hinge joint or a hinge part of the anchor rod, the coupling element is formed as a lock foldable at the centerline of the coupling element; wherein the element is used for retaining soil, avalanche fall, debris, rocks, or similar materials to be retained; and wherein the planar retainer is used for receiving a load of material to be retained and for stopping an advancing movement of the material to be retained.

2. The element according to claim 1, wherein the planar retainer is a wire mesh or a net.

3. The element according to claim 1, wherein the coupling element comprises a folding hinge.

4. The element according to claim 1, wherein the coupling element has a central opening, recess or bore for swivelably receiving a hinge part of the anchor rod.

5. The element according to claim 1, wherein the struts each have a plurality of fixing places for retaining cables.

6. The element according to claim 1, wherein releasable fixings for the struts are provided at the coupling element.

7. The element according to claim 1, wherein variably adjustable fixings for the struts are provided at the coupling element at the angle of the struts.

8. The element according to claim 1, wherein a hinge-part-shaped receiving opening for a correspondingly-shaped hinge part of the anchor rod is provided in the coupling element.

9. The element according to claim 4, wherein the central opening for the hinge part can be opened by a folding hinge fixable with screw connections, for inserting the anchor rod.

10. The element according to claim 1, wherein the retaining cables are provided with adjustment structure for variably adjusting the effective length or for tensioning.

11. The element according to claim 1, wherein, for the assembly and opening and for closing of the hinge joint receiving opening for the hinge joint or the hinge part of the anchor rod, the coupling element is formed as the lock foldable at the centerline of the coupling element.

* * * * *